US005335685A

United States Patent [19]

Dahulich

[11] Patent Number: 5,335,685

[45] Date of Patent: Aug. 9, 1994

[54] HOLD DOWN CHANNEL ASSEMBLY FOR TENTS, CANOPIES OR AWNINGS

[75] Inventor: Wayne Dahulich, Castle Creek, N.Y.

[73] Assignee: Johnson Camping, Inc., Binghamton, N.Y.

[21] Appl. No.: 52,769

[22] Filed: Apr. 26, 1993

[51] Int. Cl.[5] ..... E04H 15/44

[52] U.S. Cl. ..... 135/106; 24/134 KB; 296/100; 135/909; 135/118

[58] Field of Search ..... 135/101, 909, 119, 118; 403/171; 24/134 KB, 134 R, 68 CT; 211/182; 52/222; 296/100

[56] References Cited

U.S. PATENT DOCUMENTS

| | | | |
|---|---|---|---|
| 2,185,629 | 1/1940 | Dixon | 135/118 X |
| 2,665,431 | 1/1954 | Elsner | 24/134 KB |
| 3,044,476 | 7/1962 | Avery | 135/118 X |
| 3,143,122 | 8/1964 | Goodrich | 135/118 X |
| 3,192,542 | 7/1965 | Mills, II | 135/119 X |
| 3,668,743 | 6/1972 | Roberts | 24/68 CT |
| 4,694,543 | 9/1987 | Conley | 52/222 X |
| 4,763,452 | 8/1988 | Harvey | 52/222 X |
| 5,167,246 | 12/1992 | Mortenson | 135/106 |
| 5,226,440 | 7/1993 | Fuhrman | 135/106 |
| 5,261,436 | 11/1993 | Funk | 135/909 X |

*Primary Examiner*—Carl D. Friedman
*Assistant Examiner*—Lan C. Mai
*Attorney, Agent, or Firm*—Foley & Lardner

[57] ABSTRACT

A readily assemblable and disassemblable tent, awning or canopy structure including tubular beams, rafters and uprights interconnected by slip fit junction fittings in telescope relation with respect to the beams, rafters and uprights, the improvement comprising a hold down channel assembly mounted on the upright member of the slip fit junction fitting, the channel member assembly including a rod pivotally mounted on the lower end of the channel member, a bail ring mounted on said rod, a strip of webbing attached to the tent, awning or canopy top and wrapped around the rod of the bail ring, and a tie down cable connected to the lower end of the bail for anchoring the tent structure to the ground.

6 Claims, 4 Drawing Sheets

HOLD DOWN CHANNEL ASSEMBLY FOR TENTS, CANOPIES OR AWNINGS

FIELD OF THE INVENTION

The present invention relates to assemblable and disassemblable frame structures such as used for tents, awnings, canopies, and the like and more particularly to a hold down channel assembly mounted on each of the slip fit junction fittings in the frame structure for anchoring the structure to the ground and the tent, awning or canopy top to the structure.

BACKGROUND OF THE INVENTION

Description of the Prior Art

Conventional tent, awning and canopy frame structures of a readily assemblable and disassemblable nature are made up of cylindrical tubes with various types of connectors such as slip fit or slip on junction fittings, commonly termed corner, ridge or intermediate brackets and three-way crown, four-way crown, etc. The junction fittings and brackets are fabricated of aluminum, steel tubing, wood, etc. to assemble the uprights, beams and rafters with the rafters interconnected by crown fittings at the ridge or peak. The tubes and fittings are joined together in a telescoping manner with the tubes telescoped over the associated arms of the junction fittings. The tubes and junction fittings are interlocked by so-called locking pins. The tent, awning or canopy top is then mounted on the frame and secured to the frame. The frame structure is tied down to stakes driven into the ground.

SUMMARY OF THE PRESENT INVENTION

The principal feature and advantage of the present invention is the provision of a hold down channel assembly which is mounted on the junction fittings for the frame structure. The channel assembly includes a rod or pin to provide an anchor point for the tie down web and a bail mounted on the rod or pin which provides an anchor point for the tie down cord (guy rope) to the ground stake.

It is a primary feature of the present invention to provide a hold down channel assembly for quickly and easily anchoring the frame structure to the ground as well as providing a readily accessible fixture for tightly securing the tent, awning or canopy top to the frame structure.

The readily assemblable and disassemblable tent, awning or canopy structure generally includes a number of beams, rafters and uprights interconnected by slip fit function fittings having tubular extensions in telescope relation to the beams, rafters and uprights, a tent, awning or canopy top overlying the beams, rafters and uprights and a hold down channel assembly mounted on the extensions for the upright members, the hold down channel assembly including a channel member having side walls, a rod or pin pivotally mounted on the side walls and a bail mounted on the rod or pin, a number of webs having one end secured to the top and the other end to the rod or pin and a guy rope connected to the bail for securing the fitting to the ground.

Other principal features and advantages of the invention will become apparent to those skilled in the art upon review of the following drawings, the detailed description and the appended claims.

Figure 1:
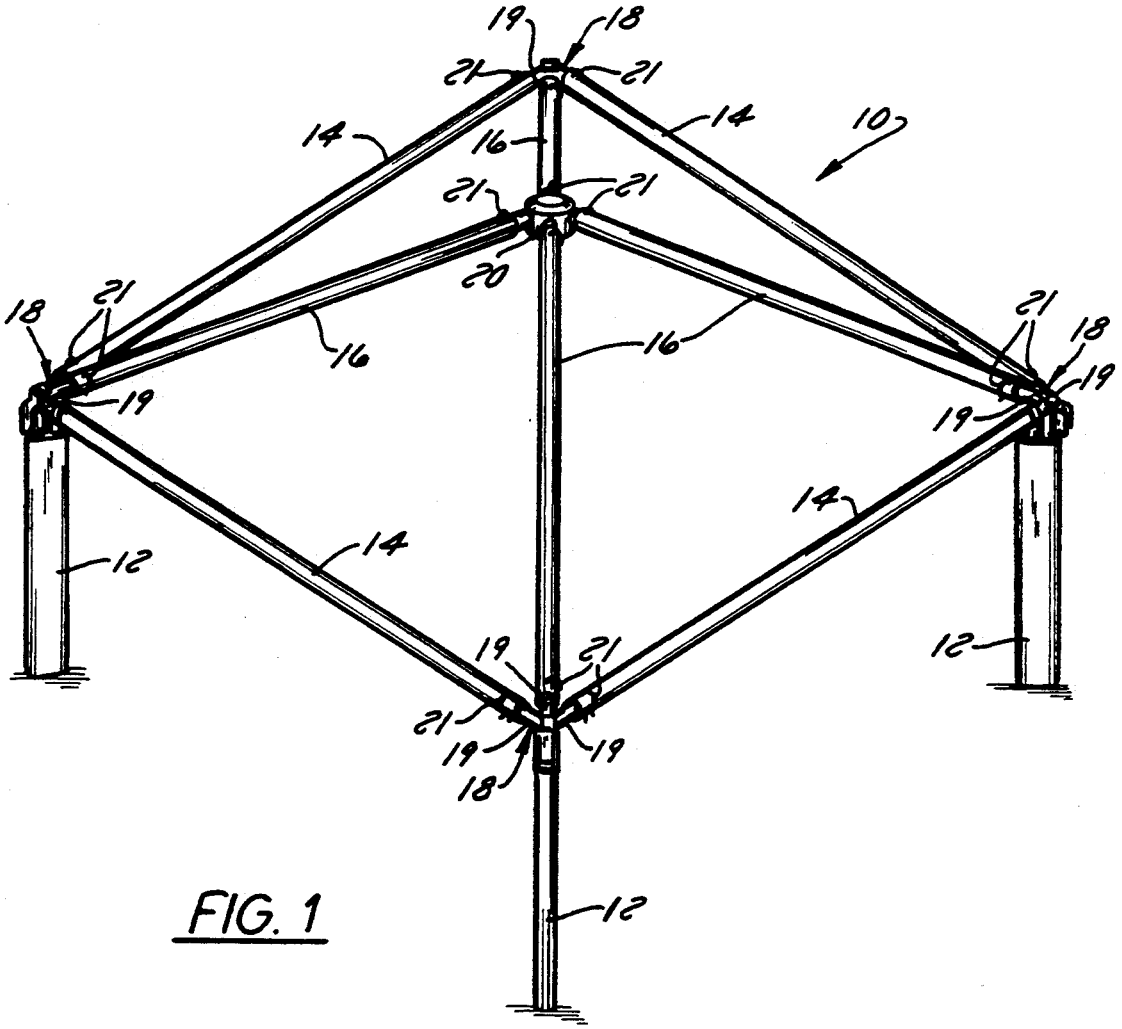
FIG. 1 is a perspective view of a conventional tent frame structure with the hold down assemblies shown mounted on the slip fit junction fittings.
Figure 2:
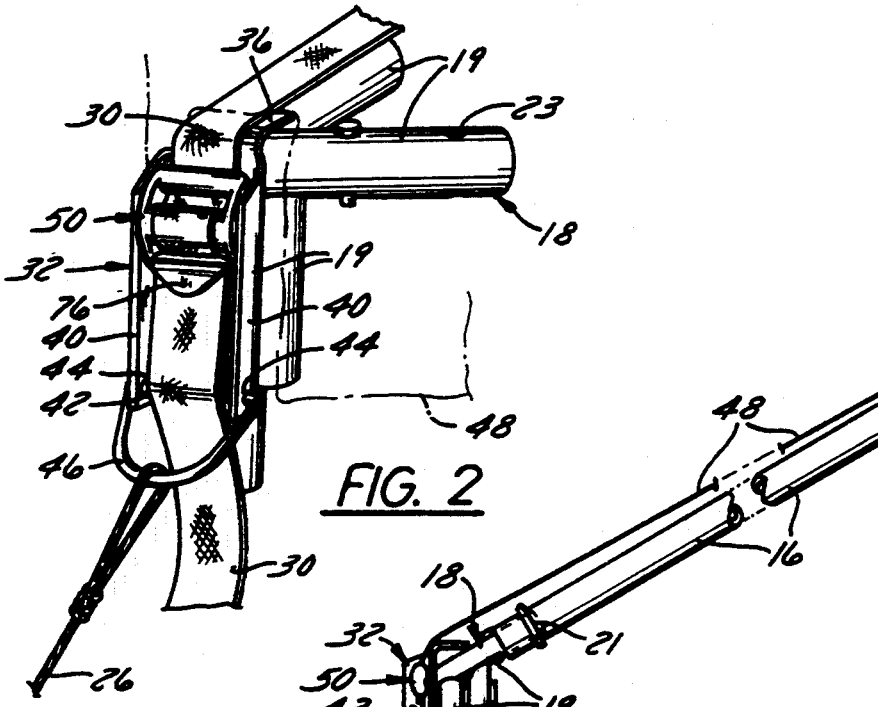
FIG. 2 is a perspective view of the hold down channel assembly according to the present invention.
Figure 3:
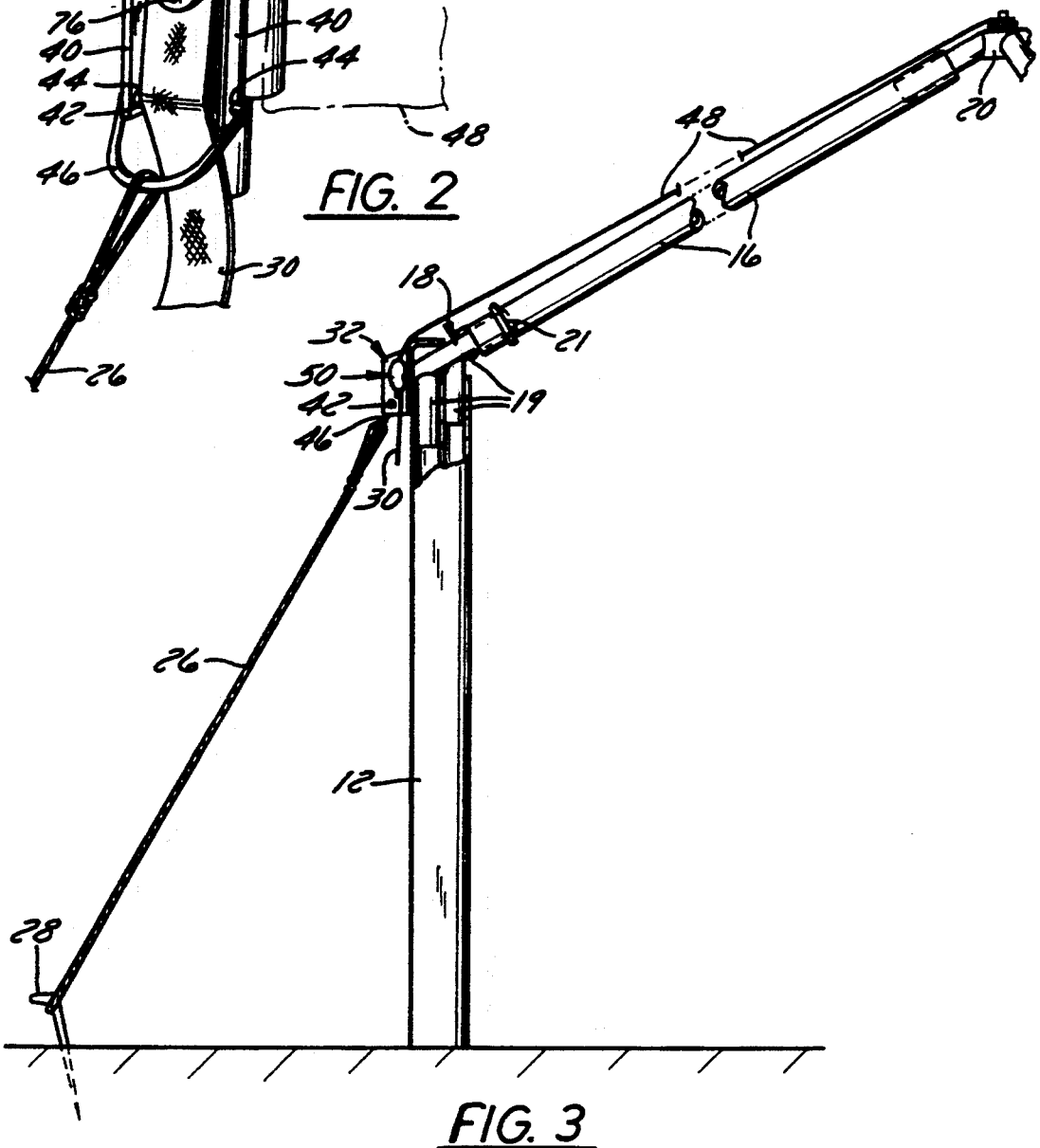
FIG. 3 is a side view of the hold down assembly with the guy rope connected to the bail and the tent web connected to the pin.
Figure 4:
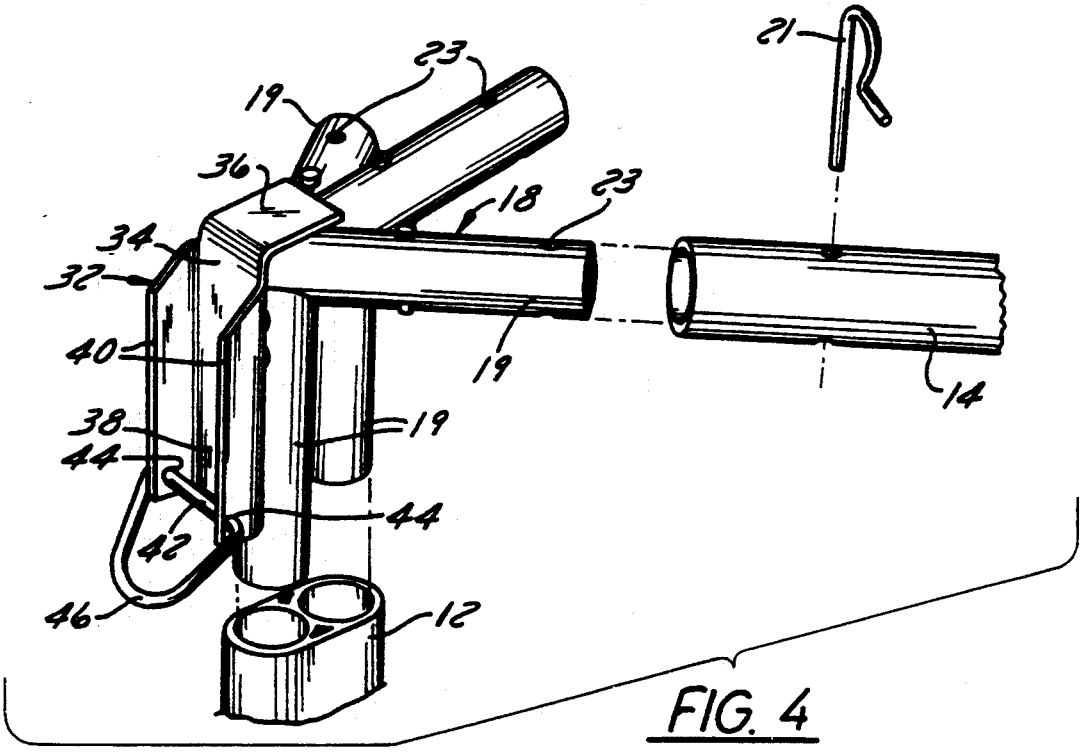
FIG. 4 is an exploded perspective view of a corner junction fitting.
Figure 5:
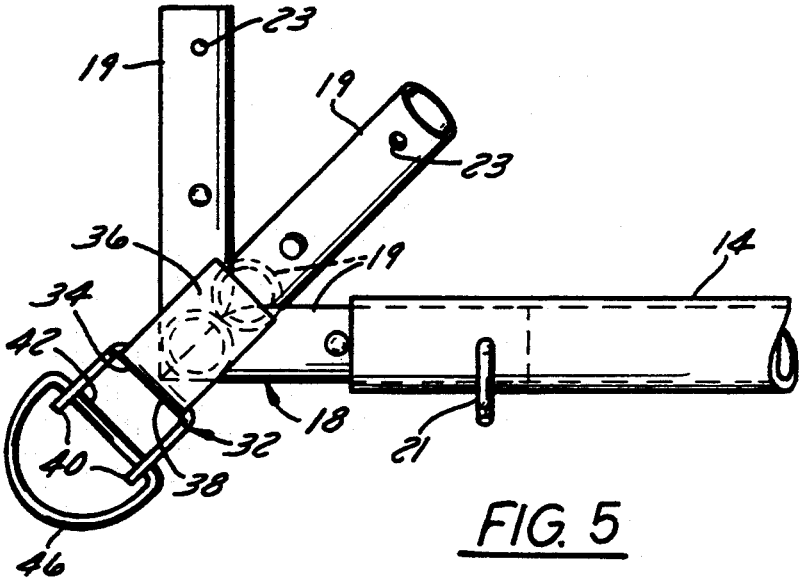
FIG. 5 is a top view of a corner junction fitting having a hold down assembly mounted thereon.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Referring to FIG. 1 of the drawings a tent frame structure 10 is shown which includes uprights or posts 12, beams 14 and rafters 16. The uprights, rafters and beams are interconnected by corner junction fittings 18 having tubular extensions 19 which are slidably mounted in the ends of the uprights, beams and rafters. The extensions are locked in the uprights, beams and rafters by lock pins 21 which pass through holes 23 in extensions 19. The upper end of the rafters 16 are connected to a crown fitting 20. The uprights 12 are anchored to the ground by tie down ropes or cables 26 connected to stakes 28. A tent top (partially shown in FIG. 6) is draped over the frame structure 10 and secured thereto by webs 30.

In accordance with the present invention the hold down channel assemblies 32 are mounted on the upright extension 19 of each junction fitting 18. The channel assemblies 32 generally include an elongate panel or plate 34 having an upper section 36 and a lower section 38. The upper section 36 is bent to the angle of the rafters 16. A pair of side walls 40 are provided along each edge of the lower sections 38. A pin or rod 42 is pivotally mounted in openings 44 on the lower end of the side walls 40. A bail 46 is mounted on the ends of the rod 42 for pivotal movement with respect to the side walls 40. The frame structure 10 is anchored to the ground by connecting the bail 46 to the stake 28 by tie down ropes or cables 26.

Figure 6:
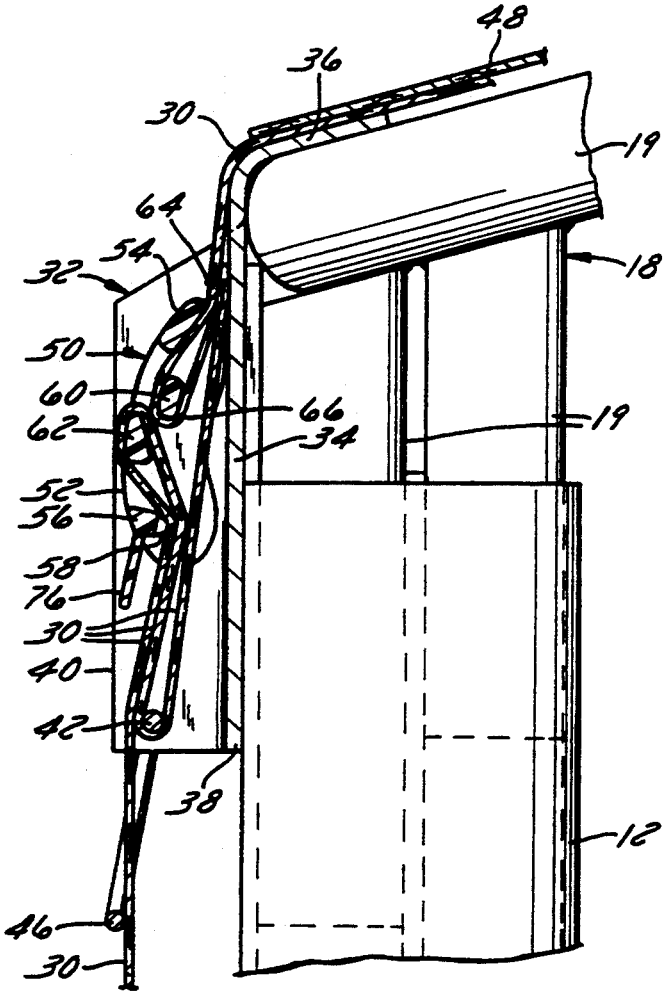
FIG. 6 is a cross section view of the hold down channel assembly.
Figure 7:
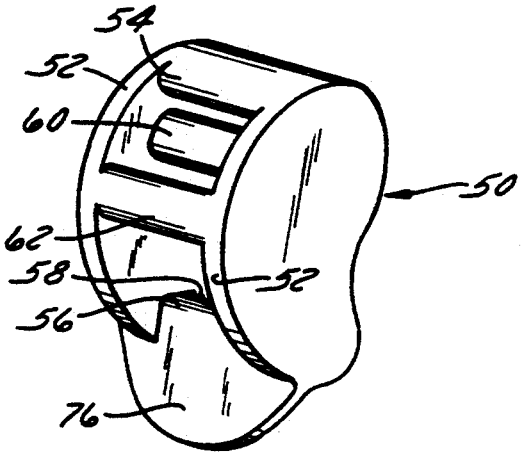
FIG. 7 is a perspective view of a ladder lock.

The tent top 48 is secured to the frame by webs 30. In this regard the webs 30 are attached at one end to the tent top 48 and at the other end to a ladder lock or buckle 50 which is aligned with the side walls 40 of the channel assembly as shown in FIGS. 6 and 7. The ladder lock 50 includes a pair of side walls 52 connected at the upper end by a cross rod 54 and at the lower end by a lock member 56 having a row of teeth 58. The side walls 52 are located in close proximity to the side walls 40 of the channel member. A pair of cross pieces 60 and 62 are mounted in a parallel spaced relation in the center of the side walls 52. The web 30, as shown in FIG. 6, is passed under the upper cross rod 54 and around the cross piece 60. The web is folded and stitched at 64 to form a loop 66 around the cross piece 60. The web 30 is then passed around the rod 42, inside of the lower lock member 56 and around the lower cross piece 62. The end of the web 30 is then passed through the space between the web and the teeth 58 on the cross member 56. The web 30 is drawn tight by merely pulling on the end of the web to draw the web around the lower cross member 62. The teeth 58 engage the web to hold it in position. To release the web 30 from the teeth 58 a lip 76 is provided at the lower end of the ladder lock which is lifted up to move the teeth 58 away from the web 30 to allow the web to pass the teeth 58.

Thus, it should be apparent that there has been provided in accordance with the present invention a hold down channel assembly for tents, canopies or awnings that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A readily assemblable and disassemblable tent, awning or canopy structure, including tubular beams, rafters and uprights interconnected by slip fit junction fittings in telescope relation with respect to the beams, rafters and uprights each of the fittings having an upright member, the improvement comprising:

a hold down channel assembly mounted on the upright member of the slip fit junction fitting, said channel member assembly including a channel member, wherein said channel member having a lower end, a rod pivotally mounted on the lower end of the channel member, a bail mounted on the ends of said rod, a strip of webbing attached to the tent, awning or canopy top and anchored to said rod, and a tie down cable connected to said bail for anchoring the channel member to the ground.

2. The structure according to claim 1 including a ladder lock mounted on the tent webbing with one loop of the webbing passing through the ladder lock, around the rod and back through the ladder lock.

3. The structure according to claim 2 wherein said channel member includes a pair of side walls and said ladder lock being aligned with said side walls.

4. The combination of a tent, canopy or awning top each having a number of tie down webs, a frame structure formed from a number of uprights, beams and rafters for supporting the tent, canopy or awning top, and a number of slip fit junction fittings for joining the uprights, beams and rafters, each of said fittings having upright, beam and rafter extensions corresponding to the uprights, beams and rafters and a hold down channel assembly for securing the tent, canopy or awning top to the frame structure and the frame structure to the ground, said assembly comprising:

a channel member having an elongate base plate including a lower section secured to the upright extension and an upper section secured to the rafter extension, a pair of side walls mounted in a parallel spaced relation on said lower section, a rod pivotally mounted in a transverse relation to said side walls and a bail mounted on said rod whereby each web for the tent, canopy or awning top is attached to a rod and a guy rope is attached to said bail to secure the frame structure to the ground.

5. The combination according to claim 4 wherein the tie down webs each include a ladder lock having upper and lower cross members, said web including a loop formed around said upper cross member and the end of the web being looped around the rod and the lower cross member.

6. The combination according to claim 5 wherein said ladder lock includes a cross rod below the lower cross member and a plurality of teeth on said cross rod for engaging and locking said web in the ladder lock.

* * * * *